US010697214B2

(12) United States Patent
Onorato et al.

(10) Patent No.: US 10,697,214 B2
(45) Date of Patent: Jun. 30, 2020

(54) LATCH

(71) Applicant: GEM Products, Inc., Orange Park, FL (US)

(72) Inventors: Matthew Stewart Onorato, Jacksonville, FL (US); Jason Sarnowski, Jacksonville, FL (US)

(73) Assignee: GEM Products, Inc., Jacksonville, FL (US)

( * ) Notice: Subject to any disclaimer, the term of this patent is extended or adjusted under 35 U.S.C. 154(b) by 673 days.

(21) Appl. No.: 14/853,005

(22) Filed: Sep. 14, 2015

(65) Prior Publication Data

US 2017/0074012 A1 Mar. 16, 2017

(51) Int. Cl.

| | |
|---|---|
| ***E05C 9/00*** | (2006.01) |
| ***E05C 1/10*** | (2006.01) |
| ***E05C 19/02*** | (2006.01) |
| ***E05B 15/04*** | (2006.01) |
| ***E05C 21/00*** | (2006.01) |
| ***E05B 17/00*** | (2006.01) |

(52) U.S. Cl.

CPC ..... *E05C 9/002* (2013.01); *E05B 15/04* (2013.01); *E05B 17/002* (2013.01); *E05C 1/10* (2013.01); *E05C 19/028* (2013.01); *E05C 21/00* (2013.01)

(58) Field of Classification Search

CPC ..... Y10T 292/096; Y10T 292/0969; Y10T 292/097; Y10T 292/0974; Y10T 292/0977; Y10T 292/0994; Y10T 292/1015; Y10T 292/1016; Y10T 292/102; Y10T 70/5111; Y10T 70/569; Y10T 70/5761; Y10T 70/5496; Y10T 70/5491; Y10T 70/5757; Y10T 70/5805; Y10T 70/5819; Y10T 70/5823; Y10T 70/5827; Y10T 70/5832; E05C 1/085; E05C 1/10; E05C 1/12; E05C 1/14; E05C 1/145; E05C 9/002; E05C 19/028; E05C 21/00; E05B 15/04; E05B 17/002; Y10S 70/5111; Y10S 70/569; Y10S 70/5761; Y10S 70/5496; Y10S 70/5491; Y10S 70/5757; Y10S 70/5805; Y10S 70/5819; Y10S 70/5823; Y10S 70/5827; Y10S 70/5832; Y10S 70/31; Y10S 292/31

See application file for complete search history.

(56) References Cited

U.S. PATENT DOCUMENTS

| | | | | |
|---|---|---|---|---|
| 3,743,336 A * | 7/1973 | Andrews | E05C 1/145 292/DIG. 31 |
| 4,872,326 A * | 10/1989 | Aurness | E05C 1/14 70/133 |
| 6,460,902 B1 * | 10/2002 | Kyle | E05C 1/145 292/DIG. 31 |
| 6,877,782 B2 * | 4/2005 | Magnusson | E05C 1/145 292/DIG. 31 |

(Continued)

*Primary Examiner* — Alyson M Merlino
(74) *Attorney, Agent, or Firm* — Seyfarth Shaw LLP

(57) ABSTRACT

A latch that is waterproof or water-resistant so as to resist the entry of water through the latch. The latch can be a slam latch having a pawl with a shaft. A sealing element, for example, a collar and/or an O-ring, can be placed around the shaft of the pawl to resist water from entering through the latch. The pawl can also enclose the cavity in which the latch handle is maintained so water cannot enter through the cavity. Other measures, such as a gasket and selective welding, can also be implemented to improve the water-resistance of the latch.

16 Claims, 7 Drawing Sheets

(56) References Cited

U.S. PATENT DOCUMENTS

| | | | | |
|---|---|---|---|---|
| 6,953,209 | B2 * | 10/2005 | Jackson, Jr. | E05B 17/0025 292/DIG. 31 |
| 7,452,010 | B2 * | 11/2008 | Cotton | E05B 1/0092 292/DIG. 31 |
| 8,579,337 | B2 * | 11/2013 | Hidding | E05B 7/00 292/DIG. 31 |
| 2003/0234542 | A1 * | 12/2003 | Furlong | E05B 17/002 292/121 |
| 2005/0093307 | A1 * | 5/2005 | Perkins | E05C 1/145 292/300 |
| 2011/0115239 | A1 * | 5/2011 | Imatomi | E05B 85/22 292/143 |

* cited by examiner

LATCH

TECHNICAL FIELD OF THE INVENTION

The present application relates generally to latches. More particularly, the present application relates to a water-resistant slam latch.

BACKGROUND OF THE INVENTION

Slam latches are a widely-used latch in door applications. Slam latches include spring-loaded catches or plungers that latch a door shut when the door is pushed shut against the bias of the spring-loaded catch. The door can therefore be "slammed" shut to activate the latching mechanism, giving the slam latch its name. Some slam latches also include key locks to lock the latch and, accordingly, maintain the door in a closed position.

Some slam latches are used in applications where water is a factor, for example, on boats or other marine vessels. In these applications, a waterproof latch can be advantageous because water can otherwise flow through the area where the latch is disposed. For example, some slam latches are located within a bore, and water can seep through the bore if the seal between the latch and bore is not waterproof. Conventional latches lack waterproof or water-resistant qualities and therefore allow water to penetrate into areas of the boat that are meant to stay dry.

SUMMARY OF THE INVENTION

The present invention broadly comprises a slam-type latch that is waterproof or water-resistant to substantially prevent water from passing through the latch. For example, the latch can include a pawl having a shaft with a sealing member disposed around the shaft to reduce the possibility of water entering through the latch. The pawl can also enclose the cavity in which the latch handle is maintained so water cannot enter through the cavity. The sealing member can include a collar and O-ring located around the shaft to help seal an orifice in which the shaft moves.

In an embodiment, the present invention broadly comprises a latch including a body having a cavity, a handle pivotably disposed within the body in the cavity, a pawl movably coupled to the handle and having a shaft disposed within an orifice; and a sealing member disposed around the shaft, thereby providing a substantially water-tight seal between the shaft and the orifice.

Further disclosed is a latch including a body having a cavity with an orifice, a handle rotatably disposed within the cavity, a shaft disposed within the orifice and movable by the handle, a catch coupled to the shaft and adapted to engage a receiving surface to latch an object shut, and a sealing member disposed around the shaft within the orifice, thereby providing a substantially water-tight seal between the shaft and the orifice.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1A:
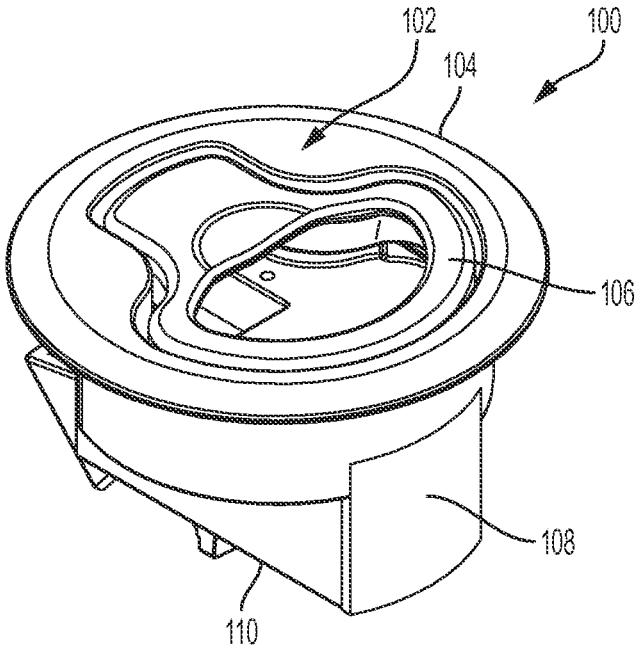
FIG. 1*a* is a top perspective view of a latch according to an embodiment of the present invention.
Figure 1B:
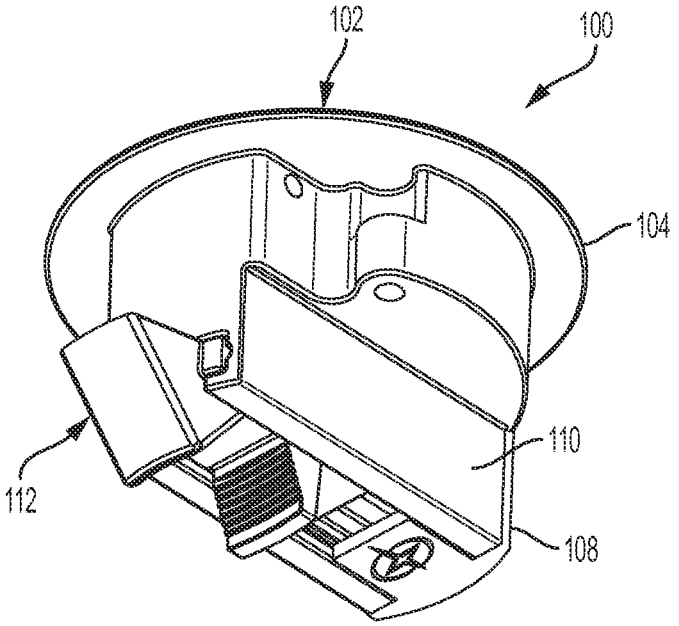
FIG. 1*b* is a bottom perspective view of a latch according to an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention includes a latch that is substantially waterproof or water-resistant to resist water from passing through the latch or a bore in which the latch is disposed. For example, the latch can be a slam latch with a pawl having a shaft. A sealing member, for example a collar and O-ring, can be disposed around the shaft to reduce water entering through the latch. In particular, the collar can be located around the shaft and can maintain the O-ring in position to help seal an orifice in which the shaft moves. The pawl can enclose the cavity in which the latch handle is maintained so water cannot enter through the cavity.

Referring to FIGS. 1*a*-6*b*, a latch 100 can include a body 102 having an outer rim 104, and a handle 106 pivotably disposed within the body 102. A cover 108 can be coupled to a lower housing 110, and a pawl 112 can be movably disposed and at least partially housed within the lower housing 110. As discussed below, the pawl 112 can engage a door frame or other suitable structure to keep the door or hatch that the latch 100 is coupled to in a closed position.

Figure 2:
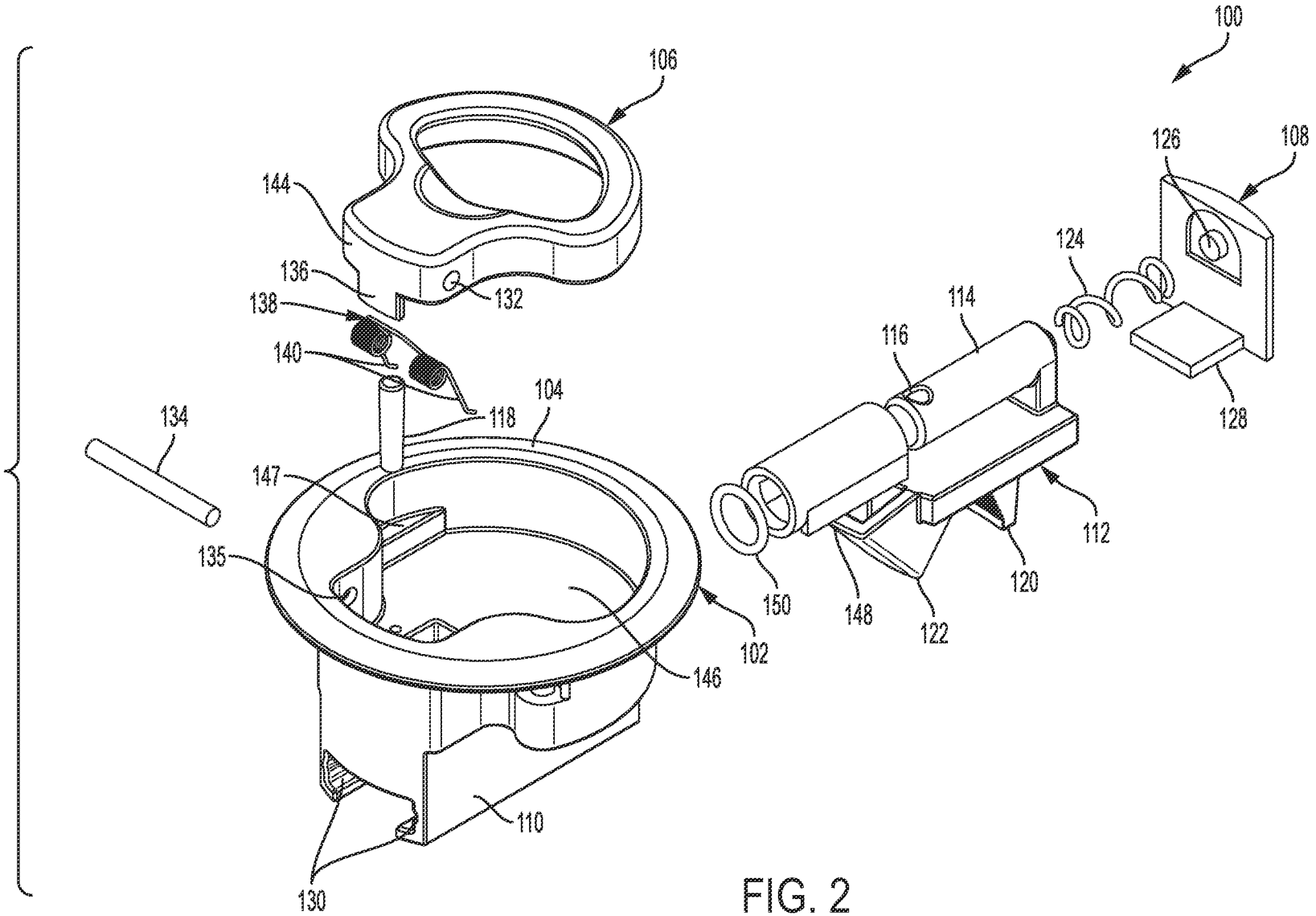
FIG. 2 is an exploded front perspective view of a latch according to an embodiment of the present invention.

Referring to FIG. 2, the pawl 112 further includes a shaft 114 with an opening 116 defined in the shaft 114. For example, the opening 116 can be perpendicular to an axial direction of the shaft, and therefore extend vertically through the shaft 114. The opening 116 can receive a shaft pin 118 that allows the handle 106 to move the pawl 112 forward or backward based on the desired orientation of the latch 100.

The pawl 112 can further include a push body 120 and a catch 122, for example, below the shaft 114. The push body 120 can receive a manual actuation from a user and allow the catch 122 to release from engagement with a door frame or other receiving structure. The pawl 112 is elastically biased in the outwardly extended position because of an elastic element 124 pushing against the pawl 112 on a first end, and pushing against the cover 108 on a second end opposite the first end. For example, the cover 108 can include a bump 126 that aligns the elastic element 124 in place and allows the elastic element 124 to bias the pawl 112 into the outwardly extended position. The user, however, can push the pawl 112 into the received position by rotating the handle 106, as discussed below, or by pushing on the push body 120 and overcoming the bias of the elastic element 124, thus allowing the catch 122 to disengage a jamb to allow the door to be opened.

The cover 108 can include an extension 128 that couples with the lower housing 110 to at least partially house the pawl 112. For example, as shown, the extension 128 can slidably couple with rails 130 or other coupling members in the lower housing 110 to couple the cover 108 to the body 102. The pawl 112 can move along either the same rails 130 that the cover 108 is inserted into, or other rails in the lower housing 110. Alternately, the cover 108 can be coupled to the body 102 by other means, for example fasteners.

Figure 4:
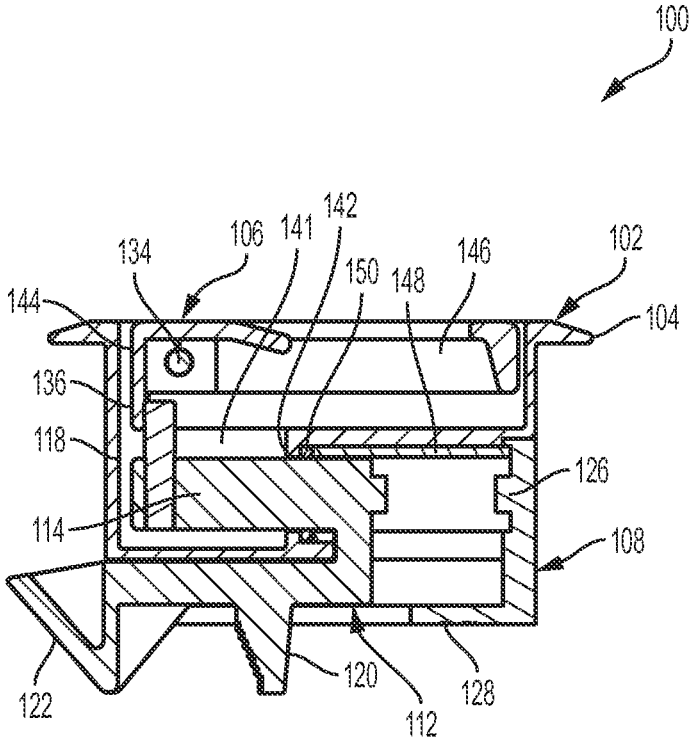
FIG. 4 is a cross-sectional view taken along line 4-4 of FIG. 3 according to an embodiment of the present invention.
Figure 5A:
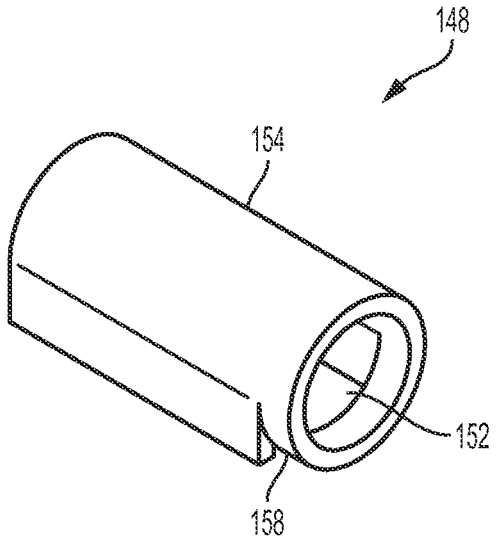
FIG. 5*a* is a top perspective view of a collar for a latch according to an embodiment of the present invention.
Figure 5B:
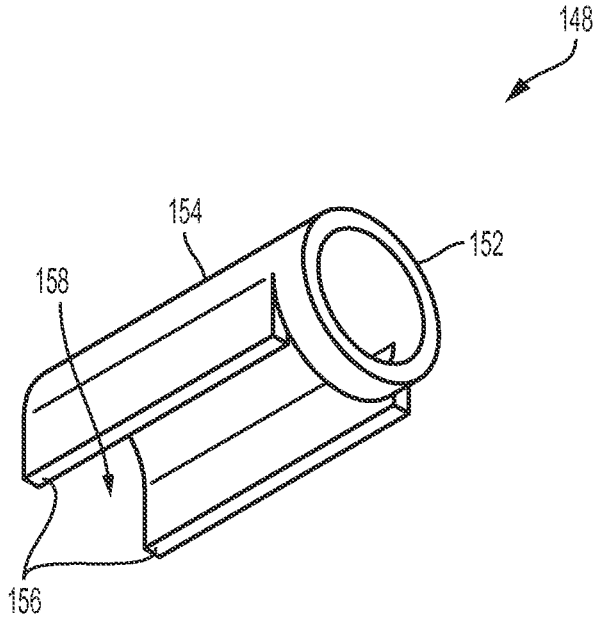
FIG. 5*b* is a bottom perspective view of a collar for a latch according to an embodiment of the present invention.

The handle 106 can include one or more handle openings 132 extending through a main body of the handle 106, as shown in FIG. 2. A pivot pin 134 can extend through the handle openings 132 and into body openings 135 to allow the handle 106 to pivot into the open or closed positions. Specifically, the handle 106 can include a tab 136 that pushes against the bias of a spring 138. The handle 106 can be biased in the closing position by the spring 138. The spring 138 can include arms 140 that push against the body 102 to bias the handle 106 in the closing position. Specifically, the tab 136 can push against the shaft pin 118 and cause the shaft pin 118 to axially move within a hole 141 of the body 102 while the shaft 114 moves within an orifice 142, as best shown in FIG. 4. The shaft pin 118 can be coupled to the pawl 112 via the pawl opening 116, and push the pawl 112 into the opening position.

In some embodiments, when the latch 100 is in the opening position, the handle 106 can rest on its base 144 and extend perpendicular to a cavity 146 in which the handle 106 is disposed. This position allows a user to visually confirm the latch 100 is in either of the opening or closing positions based on the position of the handle 106. However, in some embodiments, the handle 106 can be reversed to extend parallel to the cavity 146 and rest on one or more shelves 147 when in the opening position, and extend perpendicular to the cavity 146 when in the closing position. Still alternately, the handle 106 can extend parallel to the cavity 146 in both the opening and closing positions. Any other arrangement of the handle 106 can be implemented without departing from the spirit and scope of the present application, including an arrangement where the handle 106 is constantly biased in the closing position and cannot rest in the opening position.

Figure 3:
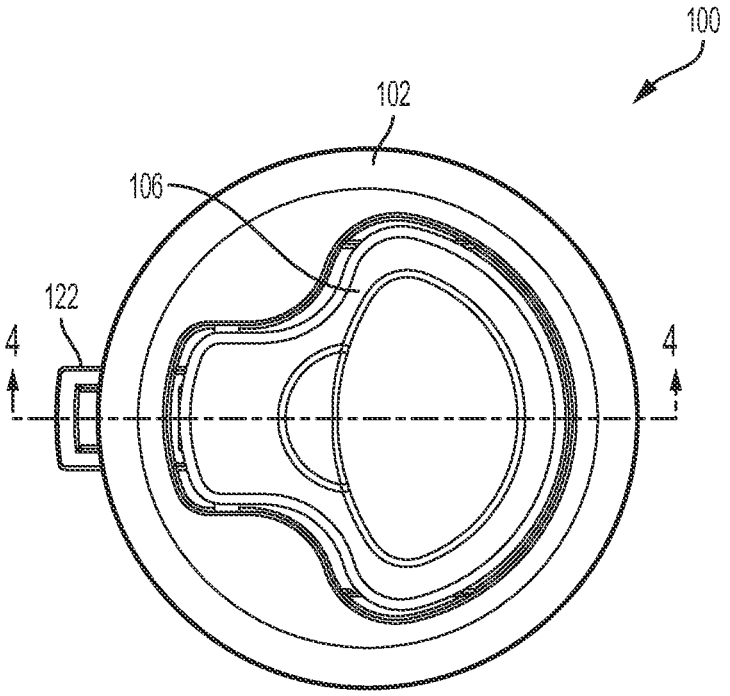
FIG. 3 is a top plan view of a latch according to an embodiment of the present invention.
Figure 6A:
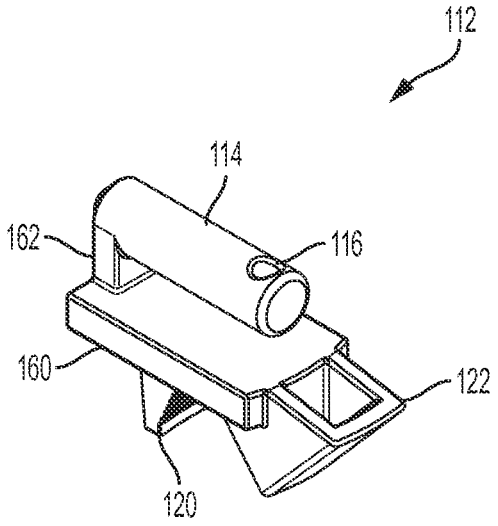
FIG. 6*a* is a top perspective view of a pawl for a latch according to an embodiment of the present invention.
Figure 6B:
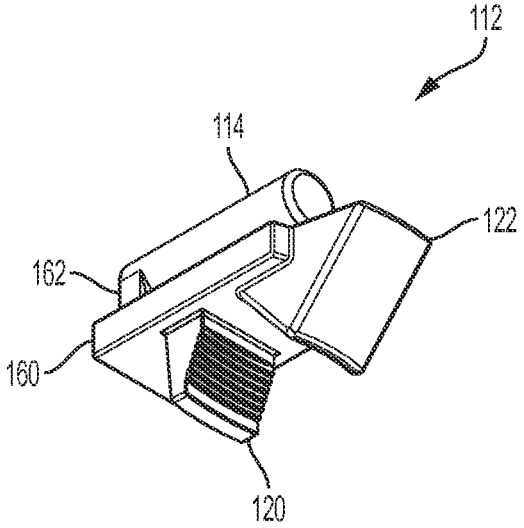
FIG. 6*b* is a bottom perspective view of a pawl for a latch according to an embodiment of the present invention.

Referring to FIGS. 2-3*b*, the latch 100 can include a sealing element that helps seal the interface between the shaft 114 and the orifice 142 in which the shaft moves. For example, and without limitation, the sealing member can include a collar 148 and/or an O-ring 150 disposed around the shaft 114 of the pawl 112. For example, the collar 148 can include a collar hole 152 defined by a barrel 154. Collar walls 156 can extend from the barrel 154 toward the bottom of the collar 148. The collar hole 152 can receive the shaft 114 and allow the shaft 114 to slide within the collar hole 152 because of a collar opening 158. Specifically, as shown in FIGS. 6*a* and 6*b*, the pawl 112 can have a pawl base 160 connected to the shaft 114 by a connector 162. The bottom of the collar 152 can be open at the collar opening 158 so that the shaft 114 can slide along the collar hole 152 and not contact the connector 162.

The collar 148 and O-ring 150 contribute to the latch 100 being water proof or water resistant. For example, the collar 148 and O-ring 150 seal the lower housing 110 from external water and restrain the water from entering through the orifice 142 in which the shaft 114 moves during opening and closing. In particular, in some embodiments, the collar 148 helps maintain the O-ring in position, and in other embodiments, can act as a sealing agent itself. The O-ring 150 not only serves as a water-resistant member, but also prevents the collar 148 from sliding off the side of the shaft 114 opposite the cover 108.

As compared to conventional slam latches, the latch 100 of the present invention can further include a cavity 146 that receives the handle 106, but which is fully enclosed, and therefore waterproof. In some embodiments, the only entry points for water are the hole 141 or orifice 142. However, unlike conventional slam latches, the latch 100 of the present invention fully encloses the hole 141 with the body 102. The orifice 142 is also sealed by the shaft 114 having the collar 148 and O-ring. Accordingly, the latch 100 can be fully water proof or at least more water resistant than conventional latches.

Additional measures can also be implemented to render the latch 100 water proof or water resistant. For example, the spaces between the cover 108 and the body 102, or other portions of the latch 100, can be welded or otherwise sealed in a waterproof manner to resist water seepage. Additionally, the outer rim 104 can include a water proof or water resistant gasket extending around the periphery of the outer rim 104. Any other manner of improving the water resistance of the latch 100 can be implemented without departing from the spirit and scope of the present application.

Figure 7:
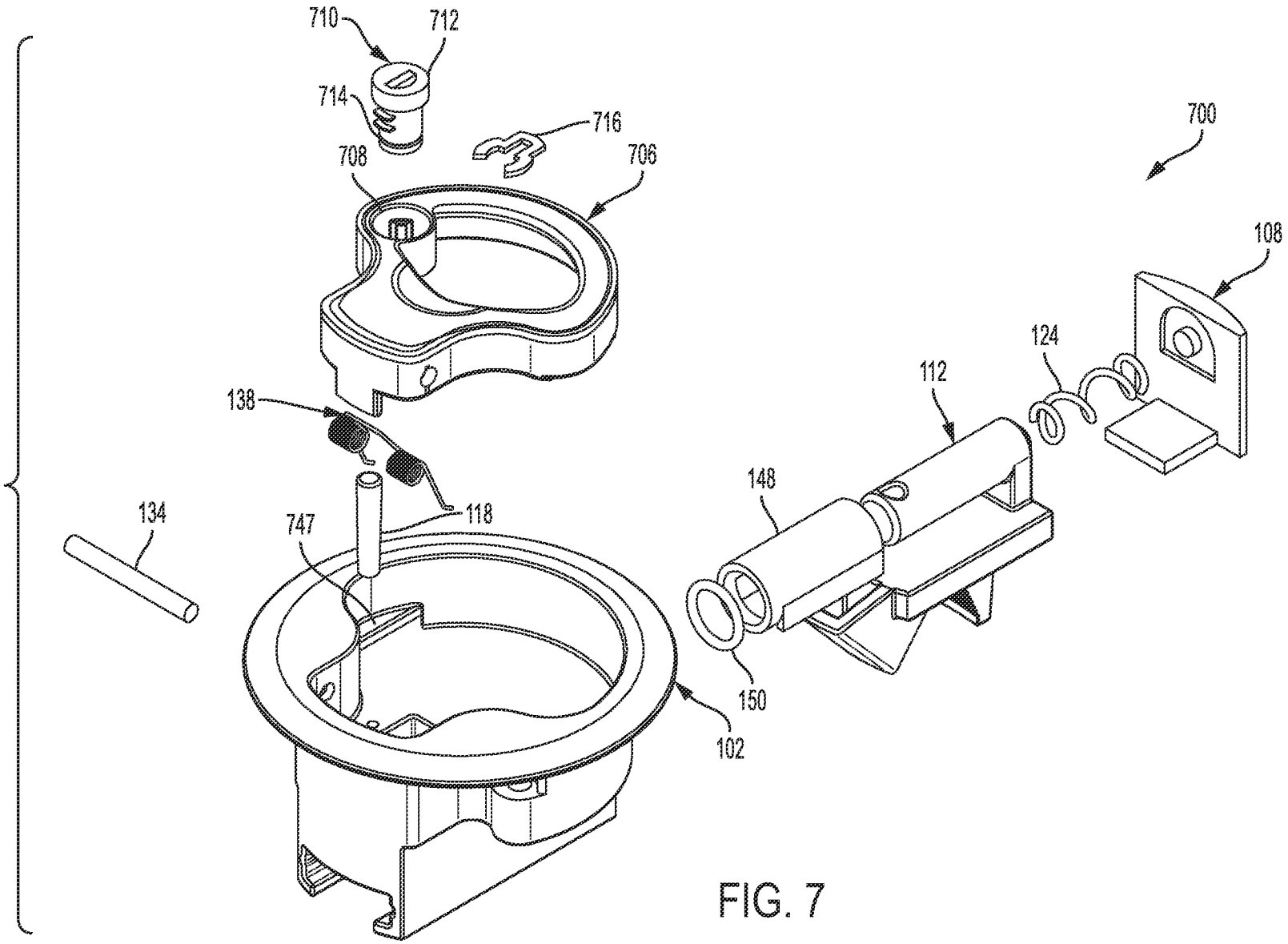
FIG. 7 is an exploded perspective view of another embodiment of a latch according to an embodiment of the present invention.

Referring to FIG. 7, in another embodiment, a locking mechanism, such that the user can lock the door or hatch shut when the latch 700 is in the closed position, can be included. As shown, the latch 700 includes a handle 706 having a handle bore 708 for receiving the lock 710. The lock 710 includes a keyhole 712 for receiving a corresponding key and locking the lock 710. The lock 710 can also include a groove 714 that receives a clip 716 to lock the lock 710 when activated by, for example, a key within the keyhole 712.

The clip 716 is rotatable by the lock 710 and can engage the underside of a shelf 747 to lock the latch 700 in place. For example, the clip 716 can be rotated by the lock 710 underneath the shelf 747, to lock the latch 100. Alternately, the clip 716 can be rotated away from the shelf 747 to unlock the latch 100. When underneath the shelf 747, the clip 716 can resist upward rotational movement of the handle 706 and therefore maintain the pawl 112 in a locked position.

As discussed above, the lock 710 can be a key lock with a keyhole 712. However, any other type of lock can be implemented without departing from the spirit and scope of the present application. For example, the lock 710 can be a combination lock, biometric lock, or any other form of lock.

As used herein, the term "coupled" and its functional equivalents are not intended to necessarily be limited to a direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The terms "upper" and "upward" are used herein and can mean, in some embodiments, upward relative to the cavity 146. For example, it is disclosed above that "the clip 716 can resist upward rotational movement of the handle 706." In this instance, the term "upward" can mean away from the cavity 146.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in following claims when viewed in their proper perspective based on the prior art.

What is claimed is:

1. A latch comprising:

a body having a cavity with an opening in a bottom of the cavity, and a first axis extending into the cavity and through the opening;

a handle with a protruding tab pivotably disposed in the cavity;

a shaft pin disposed in the opening and engageable by the -protruding tab;

a pawl coupled to the shaft pin and having a shaft disposed in an orifice, wherein the shaft pin is disposed in the shaft and the shaft has a longitudinal axis that is substantially perpendicular to the first axis, and wherein pivotal movement of the handle in an outwardly direction from the cavity causes the protruding tab to move the shaft pin laterally in the opening, which causes the shaft to move along the longitudinal axis; and a sealing element disposed around the shaft to provide a substantially watertight seal between the shaft and the orifice.

2. The latch of claim 1, further comprising a spring adapted to bias the handle towards the cavity.

3. The latch of claim 1, further comprising an elastic element adapted to bias the shaft out of the orifice.

4. The latch of claim 1, wherein the pawl is disposed in a lower housing, and further comprising a cover coupled to the lower housing.

5. The latch of claim 4, further comprising an elastic element disposed in the lower housing and adapted to bias the shaft out of the orifice.

6. The latch of claim 5, wherein the elastic element includes opposing first and second ends, the first end is coupled to the cover and the second end is coupled to the shaft.

7. The latch of claim 1, wherein the sealing element includes an O-ring disposed around the shaft.

8. The latch of claim 7, wherein the sealing element further includes a collar disposed around the shaft proximate the O-ring.

9. The latch of claim 8, wherein the collar maintains a position of the O-ring.

10. A latch comprising:

a body having a cavity and an orifice, wherein the cavity includes an opening in a bottom of the cavity, and a first axis that extends into the cavity and through the opening;

a handle with a protruding tab rotatably disposed in the cavity;

a shaft disposed in the orifice, wherein the shaft has a longitudinal axis that is substantially perpendicular to the first axis;

a shaft pin disposed in the shaft and engageable by the protruding tab, wherein rotational movement of the handle in an outwardly direction from the cavity causes the protruding tab to move the shaft pin laterally in the opening, which causes the shaft to move along the longitudinal axis;

a catch coupled to the shaft and adapted to engage a receiving surface to latch an object closed; and a sealing element disposed around the shaft to provide a substantially watertight seal between the shaft and the orifice.

11. The latch of claim 10, wherein the shaft is disposed in a lower housing, and further comprising a cover coupled to the lower housing.

12. The latch of claim 11, further comprising an elastic element disposed in the lower housing and adapted to bias the shaft out of the orifice.

13. The latch of claim 12, wherein the elastic element includes opposing first and second ends, the first end is coupled to the cover and the second end is coupled to the shaft.

14. The latch of claim 10, wherein the sealing element includes an O-ring disposed around the shaft.

15. The latch of claim 14, wherein the sealing element further includes a collar disposed around the shaft proximate the O-ring.

16. The latch of claim 15, wherein the collar maintains a position of the O-ring.

* * * * *